US006415594B1

(12) United States Patent
Durbin et al.

(10) Patent No.: US 6,415,594 B1
(45) Date of Patent: Jul. 9, 2002

(54) METHODS AND APPARATUS FOR REDUCING GAS TURBINE ENGINE EMISSIONS

(75) Inventors: Mark David Durbin, Springboro; Timothy James Held, Blanchester, both of OH (US)

(73) Assignee: General Electric Company, Cincinnati, OH (US)

( * ) Notice: Subject to any disclaimer, the term of this patent is extended or adjusted under 35 U.S.C. 154(b) by 51 days.

(21) Appl. No.: 09/583,412

(22) Filed: May 31, 2000

(51) Int. Cl.[7] ..... F02G 3/00
(52) U.S. Cl. ..... 60/39.02; 60/748
(58) Field of Search ..... 60/39.02, 737, 60/748

(56) References Cited

U.S. PATENT DOCUMENTS 3,764,071 A * 10/1973 Carlisle ..... 239/132.5
4,092,826 A * 6/1978 Pask ..... 60/39.74 R
4,222,243 A * 9/1980 Mobsby ..... 60/742
5,323,604 A * 6/1994 Ekstedt et al. ..... 60/39.36
5,675,971 A * 10/1997 Angel et al. ..... 60/746
5,680,766 A 10/1997 Joshi et al.
5,778,676 A 7/1998 Joshi et al.
5,899,075 A * 5/1999 Dean et al. ..... 60/737
6,141,967 A 11/2000 Angel et al.

* cited by examiner

*Primary Examiner*—Charles G. Freay
(74) *Attorney, Agent, or Firm*—Andrew C. Hess; William Scott Andres

(57) ABSTRACT

A gas turbine engine includes a combustor system to reduce an amount of nitrogen oxide emissions formed by the gas turbine engine. The combustor system includes a combustor including a first annular dome. A centerbody is secured within the dome and includes at least one orifice for supplying fuel to the dome. An inner swirler is attached to the centerbody and an outer swirler is attached radially outward from the inner swirler such that a leading edge of the inner swirler and a leading edge of the centerbody are disposed upstream from a leading edge of the outer swirler.

20 Claims, 4 Drawing Sheets

METHODS AND APPARATUS FOR REDUCING GAS TURBINE ENGINE EMISSIONS

BACKGROUND OF THE INVENTION

This application relates generally to gas turbine engines and, more particularly, to combustors for gas turbine engine.

Air pollution concerns worldwide have led to stricter emissions standards. These standards regulate the emission of oxides of nitrogen (NOx), unburned hydrocarbons (HC), and carbon monoxide (CO) generated as a result of gas turbine engine operation. In particular, nitrogen oxide is formed within a gas turbine engine as a result of high combustor flame temperatures. Making modifications to a gas turbine engine in an effort to reduce nitrogen oxide emissions often has an adverse effect on operating performance levels of the associated gas turbine engine.

In gas turbine engines, nitrogen oxide emissions can be reduced by increasing airflow through the gas turbine combustor during operating conditions. Gas turbine engines include preset operating parameters and any such airflow increases are limited by the preset operating parameters including turbine nozzle cooling parameters. For example, increasing airflows within domed combustors including inner and outer swirlers and premixers may cause wake recirculation to develop as airflows exiting the inner swirler separate from the swirler vanes. Furthermore, such wake recirculation permits fuel to dwell within the premixers and potentially autoignite within the premixers. Such autoignition increases emissions from the combustor and may potentially damage components within the combustor. As a result, to increase the airflow within the gas turbine combustor, the gas turbine engine and associated components often must be modified to operate at new operating parameters.

Because implementing gas turbine engine modifications is labor-intensive and time-consuming, users are often limited to derating the operating power capability of the gas turbine engine and prevented from operating the gas turbine engine at full capacity. Such derates do not limit the amount of nitrogen oxide formed as the engine operates at full capacity, but instead limit the operating capacity of the gas turbine engine.

BRIEF SUMMARY OF THE INVENTION

In an exemplary embodiment, a gas turbine engine includes a combustor system to reduce an amount of nitrogen oxide emissions formed by the gas turbine engine. The combustor system includes a combustor including a first annular dome that includes a premixer cup. A centerbody is secured co-axially within the dome and includes at least one orifice for supplying fuel to the dome. An inner swirler is attached to the centerbody and an outer swirler is attached radially outward to the inner swirler such that a leading edge of the inner swirler and a leading edge of the centerbody are disposed a distance upstream from a leading edge of the outer swirler relative to the dome. As a result, a premixing distance measured between the centerbody orifice and an exit of the dome is increased in comparison to known combustor assemblies.

During operation of the gas turbine engine, air and fuel are mixed in the dome prior to the fuel/air mixture exiting the dome for combustion. Although the premixing length is increased because the centerbody is positioned upstream from the outer swirler, because the inner swirler is also positioned upstream from the outer swirler, wake recirculation is reduced and fuel and air thoroughly mix prior to exiting the dome. As a result, nitrogen oxide emissions generated within the combustor are reduced. Furthermore, because wake recirculation is reduced, fuel is prevented from dwelling in the wake recirculation and a potential of fuel autoigniting within the combustor domes is reduced.

DETAILED DESCRIPTION OF THE INVENTION

Figure 1:
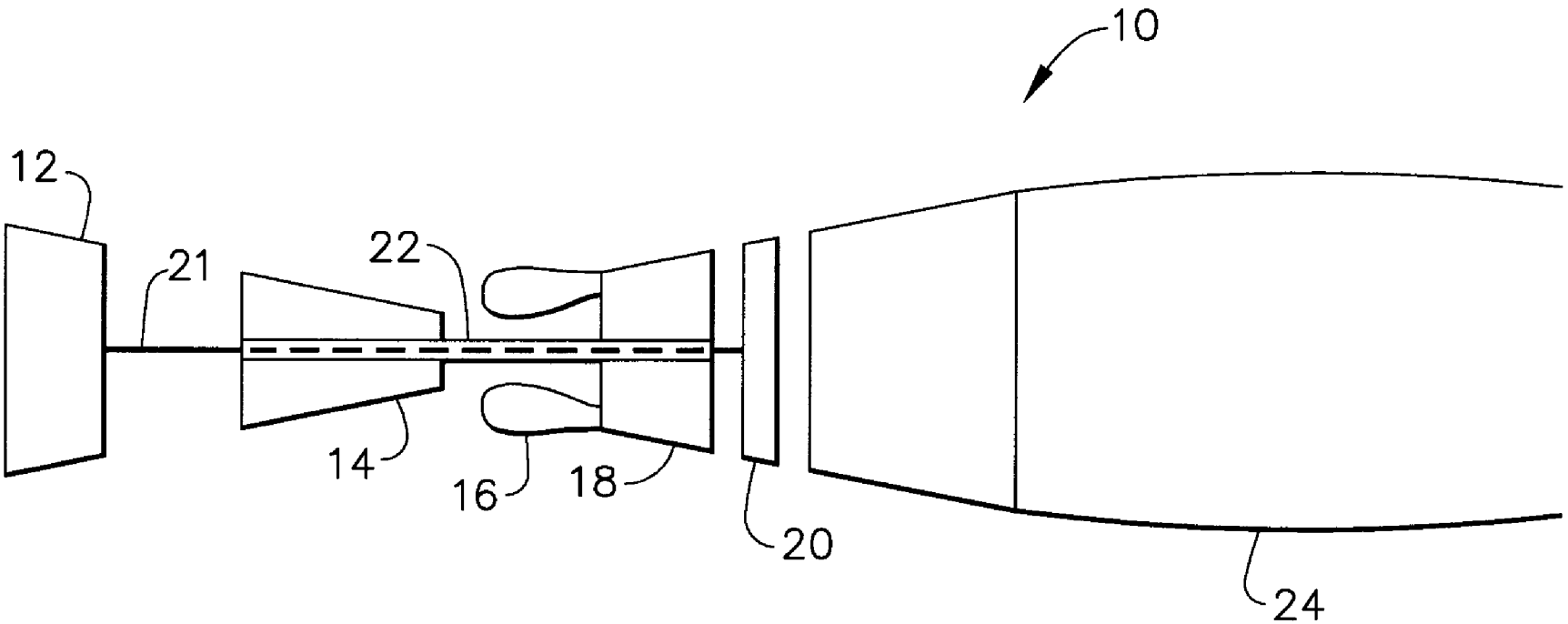
FIG. 1 is a schematic illustration of a gas turbine engine.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20. Combustor 16 is a lean premix combustor. Compressor 12 and turbine 20 are coupled by a first shaft 21, and compressor 14 and turbine 18 are coupled by a second shaft 22. A load (not shown) is also coupled to gas turbine engine 10 with first shaft 21. In one embodiment, gas turbine engine 10 is an LM6000 available from General Electric Aircraft Engines, Cincinnati, Ohio.

In operation, air flows through low pressure compressor 12 and compressed air is supplied from low pressure compressor 12 to high pressure compressor 14. The highly compressed air is delivered to combustor 16. Airflow from combustor 16 drives turbines 18 and 20 and exits gas turbine engine 10 through a nozzle 24.

Figure 2:
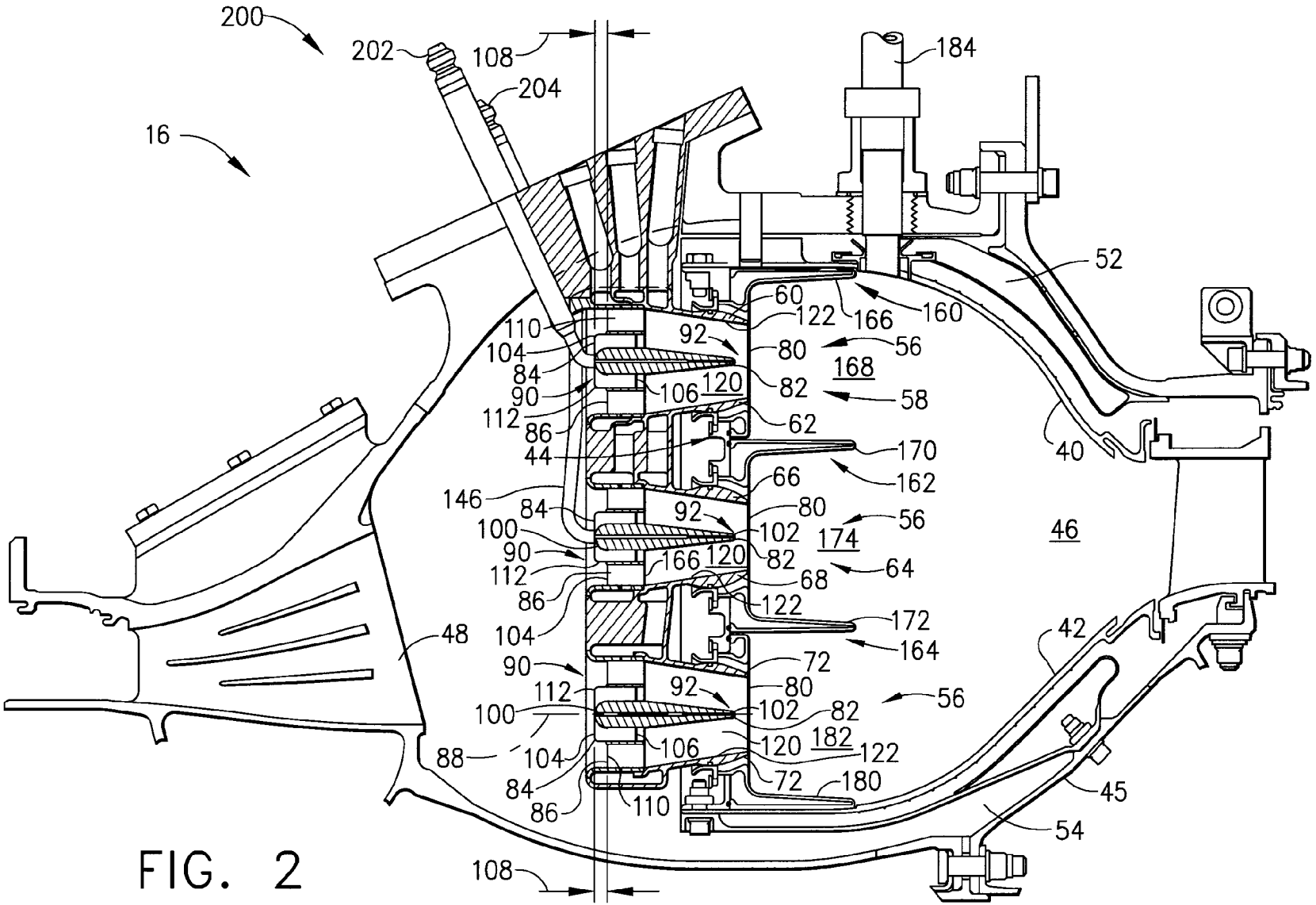
FIG. 2 is a cross-sectional view of a combustor used with the gas turbine engine shown in FIG. 1.
Figure 3:
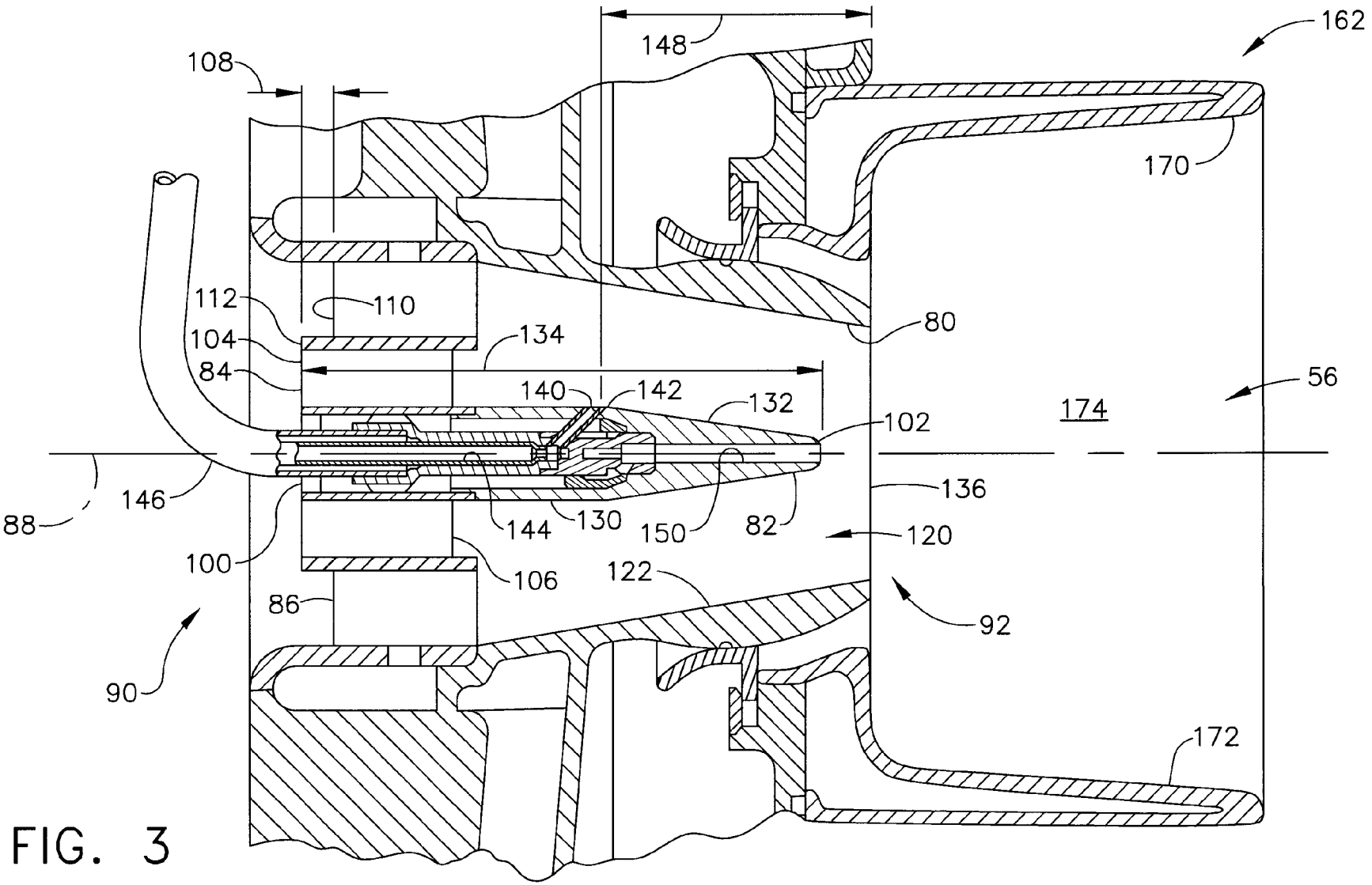
FIG. 3 is an enlarged partial cross-sectional view of the combustor shown in FIG. 2.

FIGS. 2 and 3 are a cross-sectional view and an enlarged partial cross-sectional view, respectively, of combustor 16 used in gas turbine engine 10 (shown in FIG. 1). Because a fuel/air mixture supplied to combustor 16 contains more air than is required to fully combust the fuel, and because the air is mixed with the fuel prior to combustion, combustor 16 is a lean premix combustor. Accordingly, a fuel/air mixture equivalence ratio for combustor 16 is less than one. Furthermore, because a gas and a liquid fuel are supplied to combustor 16, and because combustor 16 does not include water injection, combustor 16 is a dual fuel dry low emissions combustor. Combustor 16 includes an annular outer liner 40, an annular inner liner 42, and a domed end 44 extending between outer and inner liners 40 and 42, respectively. Outer liner 40 and inner liner 42 are spaced radially inward from a combustor casing 45 and define a combustion chamber 46. Combustor casing 45 is generally annular and extends downstream from a diffuser 48. Combustion chamber 46 is generally annular in shape and is disposed radially inward from liners 40 and 42. Outer liner 40 and combustor casing 45 define an outer passageway 52 and inner liner 42 and combustor casing 45 define an inner passageway 54. Outer and inner liners 40 and 42 extend to a turbine nozzle 55 disposed downstream from diffuser 48.

Combustor domed end 44 includes a plurality of domes 56 arranged in a triple annular configuration. Alternatively, combustor domed end 44 includes a double annular configuration. In another embodiment, combustor domed end 44 includes a single annular configuration. An outer dome 58 includes an outer end 60 fixedly attached to combustor outer liner 40 and an inner end 62 fixedly attached to a middle dome 64. Middle dome 64 includes an outer end 66 attached to outer dome inner end 62 and an inner end 68 attached to an inner dome 70. Accordingly, middle dome 64 is between outer and inner domes 58 and 70, respectively. Inner dome 70 includes an inner end 72 attached to middle dome inner end 68 and an outer end 74 fixedly attached to combustor inner liner 42.

Each dome 56 includes a plurality of premixer cups 80 to permit uniform mixing of fuel and air therein and to channel the fuel/air mixture into combustion chamber 46. In one embodiment, premixer cups 80 are available from Parker Hannifin, 6035 Parkland Blvd., Cleveland, Ohio. Each premixer cup 80 includes a centerbody 82, an inner swirler 84, an outer swirler 86, and an axis of symmetry 88 extending from an upstream side 90 of dome 56 to a downstream side 92 of dome 56. In one embodiment, inner swirler 84 and outer swirler 86 are counter-rotating. Each centerbody 82 is disposed co-axially with dome axis of symmetry 88 and includes a leading edge 100 and a trailing edge 102. In one embodiment, centerbody 82 is cast within premixer cup 80.

Each inner swirler 84 is secured to a centerbody 82 radially outward from centerbody 82 and includes a leading edge 104 and a trailing edge 106. Each outer swirler 86 is secured to an inner swirler 84 radially outward from inner swirler 84. Outer swirler 86 is attached such that inner swirler leading edge 104 is a distance 108 upstream from a leading edge 110 of outer swirler 86. In one embodiment, distance 108 is approximately equal 0.25 inches. Furthermore, when outer swirler 86 is attached, centerbody 82 is positioned such that centerbody leading edge 100 is approximately co-planar with inner swirler leading edge 104 and distance 108 upstream from outer swirler leading edge 110.

A hub 112 separates each inner swirler 84 from each outer swirler 86 and an annular mixing duct 120 is downstream from inner and outer swirlers 84 and 86, respectively. Mixing duct 120 is annular and is defined by an annular wall 122. Annular mixing duct 120 tapers uniformly from dome upstream side 90 to dome downstream side 92 to increase flow velocities within mixing duct 120. Furthermore, because mixing duct 120 converges, a fuel/air mixture flowing within mixing duct 120 is accelerated which helps to minimize boundary layers from accumulating within mixing duct 120 and thus, minimizes flashbacks stemming therefrom.

Centerbody 82 also includes a cylindrically-shaped first body portion 13Q and a conical second body portion 132. Second body portion 132 extends downstream from first body portion 130. Centerbody 82 has a length 134 extending from leading edge 100 to trailing edge 102. Length 134 is sized such that centerbody trailing edge 102 is disposed in close proximity to a trailing edge 136 of premixer cup 80.

Centerbody 82 is hollow and includes a first orifice 140 extending from an outer surface 142 of centerbody 82 to an inner passageway 144. First orifice 140 is disposed at a junction between centerbody first body portion 130 and centerbody second body portion 132. First orifice 140 is a fuel port used to supply fuel to premixer cup 80 and inner passageway 144. Orifice 140 is in flow communication with a fuel nozzle 146 positioned at centerbody leading edge 100. In one embodiment, fuel nozzles 146 are available from Parker Hannifin, 6035 Parkland Blvd., Cleveland, Ohio. A premixing length 148, defined as a distance between first orifice 140 and dome downstream side 92, ensures air and fuel thoroughly mix prior to the fuel/air mixture exiting dome 56 and entering combustion chamber 46. Because centerbody leading edge 100 is positioned upstream from outer swirler leading edge 110, premixing length 148 is increased in comparison to other known combustor premixing lengths.

A plurality of second passageways 150 extend through centerbody 82 and are in flow communication with an air source (not shown). Passageways 150 permit small amounts of air to be supplied to combustor 16 to prevent wake separation adjacent centerbody 82.

Combustor domed end 44 also includes an outer dome heat shield 160, a middle dome heat shield 162, and an inner dome heat shield 164 to insulate each respective dome 58, 64, and 70 from flames burning in combustion chamber 46. Outer dome heat shield 160 includes an annular endbody 166 to insulate combustor outer liner 40 from flames burning in an outer primary combustion zone 168. Middle dome heat shield 162 includes annular heat shield centerbodies 170 and 172 to segregate middle dome 64 from outer and inner domes 58 and 70, respectively. Middle dome heat shield centerbodies 170 and 172 are disposed radially outward from a middle primary combustion zone 174.

Inner dome heat shield 164 includes an annular endbody 180 to insulate combustor inner liner 42 from flames burning in an inner primary combustion zone 182. An igniter 184 extends through combustor casing 45 and is disposed downstream from outer dome heat shield endbody 166.

Domes 58, 64, and 70 are supplied fuel and air via a premixer and assembly manifold system (not shown). A plurality of fuel tubes 200 extend between a fuel source (not shown) and domes 56. Specifically, an outer dome fuel tube 202 supplies fuel to premixer cup 80 disposed within outer dome 58, a middle dome fuel tube 204 supplies fuel to premixer cup 80 disposed within middle dome 64, and an inner dome fuel tube (not shown) supplies fuel to premixer cup 80 disposed within inner dome 70.

During operation of gas turbine engine 10, air and fuel are mixed in premixer cups 80 and dome premixing length 148 ensures air and fuel thoroughly mix prior to the fuel/air mixture exiting dome 56 and entering combustion chamber 46. Although centerbody 82 is positioned upstream from outer swirler 86 to increase premixing length 148, because inner swirler 84 is also positioned upstream from outer swirler 86, wake recirculation is reduced and fuel and air mix thoroughly prior to exiting dome 56. As a result, nitrogen oxide emissions from combustor 16 are reduced. Furthermore, because wake recirculation is reduced, fuel is prevented from dwelling in an inner swirler airflow separation and no autoignition of the fuel occurs within premixer cup 80.

Figure 4:
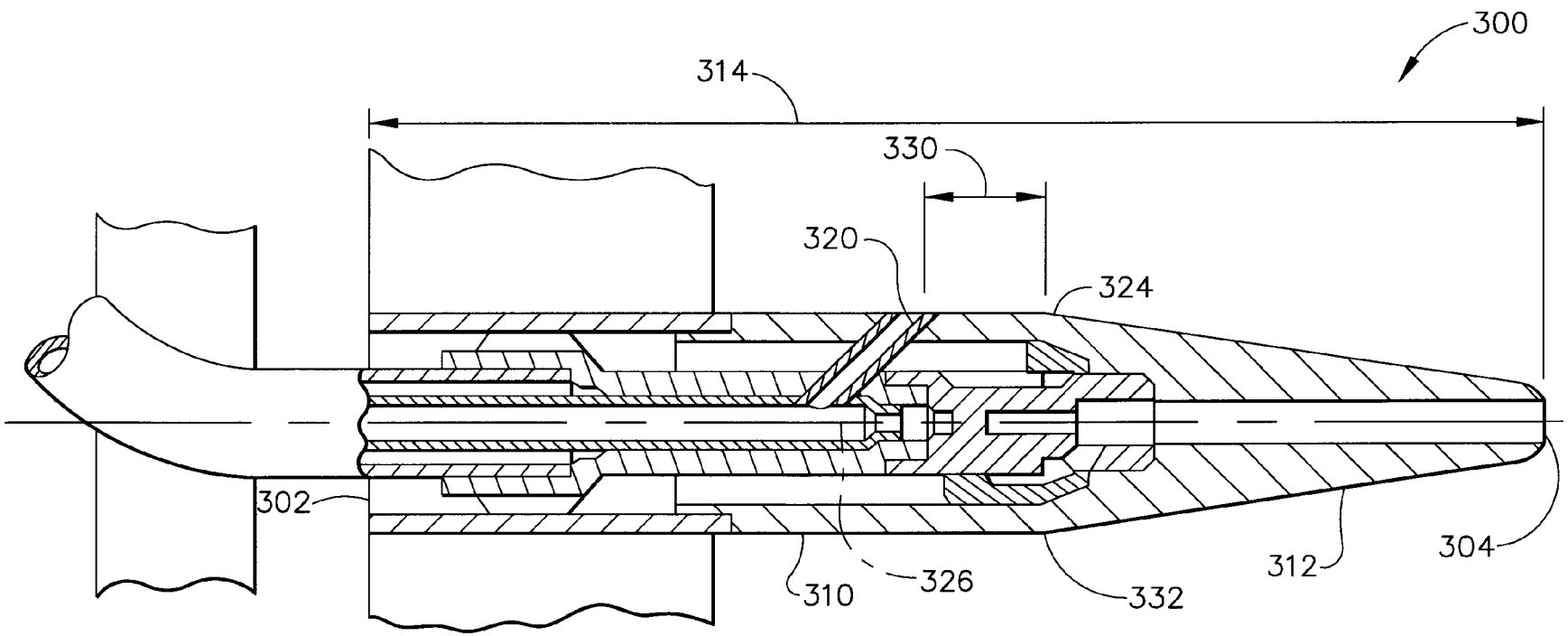
FIG. 4 is a partial cross-sectional view of an alternative embodiment of a centerbody that may be used with the combustor shown in FIG. 2.

FIG. 4 is a partial cross-sectional view of an alternative embodiment of a centerbody 300 that may be used with combustor 16 (shown in FIGS. 1 and 2). Centerbody 300 is secured within dome 56 (shown in FIGS. 2 and 3) co-axially with dome axis of symmetry 88 (shown in FIGS. 1 and 2) and includes a leading edge 302 and a trailing edge 304. In one embodiment, centerbody 300 is cast within premixer cup 80.

Centerbody 300 also includes a cylindrically-shaped first body portion 310 and a conical second body portion 312. Second body portion 312 extends downstream from first body portion 310. Centerbody 300 has a length 314 extending from leading edge 302 to trailing edge 304. Length 314 is sized such that centerbody trailing edge 304 is disposed in close proximity to premixer cup trailing edge 136 (shown in FIG. 3) when centerbody 300 is secured within dome 56.

When centerbody 300 is secured within dome 56, inner swirler 84 (shown in FIGS. 2 and 3) and outer swirler 86 (shown in FIGS. 2 and 3) are secured radially outward from centerbody 300 such that inner swirler leading edge 104 (shown in FIGS. 2 and 3) is upstream from both outer swirler leading edge 110 (shown in FIGS. 2 and 3) and centerbody leading edge 302.

Centerbody 300 is hollow and includes a first orifice 320 extending from an outer surface 324 of centerbody 300 to an inner passageway 326. First orifice 320 is disposed a distance 330 upstream from a junction 332 between centerbody first body portion 310 and centerbody second body portion 312. In one embodiment, distance 330 is approximately equal 0.25 inches. First orifice 300 is a fuel port for supplying fuel to premixer cup 80 (shown in FIG. 2) and inner passageway 326 is in flow communication with fuel nozzle 146 (shown in FIGS. 2 and 3) positioned at centerbody leading edge 316 when centerbody 300 is installed within dome 56. Dome premixing length 148 (shown in FIG. 3) is defined as a distance between first orifice 320 and dome downstream side 92 (shown in FIG. 2). Because first orifice 320 is positioned distance 330 from dome downstream side 92, dome premixing length 148 using centerbody 300 is increased in comparison to other known combustor premixing lengths.

A plurality of second passageways 340 extend through centerbody 300 and are in flow communication with an air source (not shown). Passageways 340 permit small amounts of air to be supplied to combustor 16 to prevent wake separation adjacent centerbody 300.

The above-described combustor system for a gas turbine engine is cost-effective and reliable. The combustor system includes a combustor including a centerbody, an inner swirler, and an outer swirler positioned relative to each other to provide an increased area for fuel and air to mix thoroughly prior to being directed into the combustion chamber. Furthermore, the relative positioning of the centerbody, the inner swirler, and the outer swirler reduces wake recirculation within the combustor dome. As a result, fuel does not dwell in the wake recirculation and is not susceptible to autoignition. Furthermore, as a result, nitrogen oxide emissions are reduced.

While the invention has been described in terms of various specific embodiments, those skilled in the art will recognize that the invention can be practiced with modification within the spirit and scope of the claims.

What is claimed is:

1. A method for assembling a gas turbine engine combustor to reduce an amount of emissions from the gas turbine engine, said method comprising the steps of:

providing a combustor including a plurality of annular domes, wherein each dome includes a premixer cup;

securing an inner swirler to a centerbody within a first annular dome such that the inner swirler is radially outward from the centerbody;

securing an outer swirler to the inner swirler such that the outer swirler is radially outward from the inner swirler and such that a leading edge of the outer swirler is downstream from a leading edge of the inner swirler; and securing the first annular dome within the gas turbine engine.

2. A method in accordance with claim 1 wherein said step of securing the outer swirler further comprises the step of securing the outer swirler to the inner swirler such that a leading edge of the centerbody is upstream from a leading edge of the outer swirler.

3. A method in accordance with claim 1 wherein said step of securing an outer swirler further comprises the step of securing the outer swirler to the inner swirler such that a leading edge of the centerbody is approximately 0.25 inches upstream from a leading edge of the outer swirler.

4. A method in accordance with claim 1 wherein said step of securing an outer swirler further comprises the step of securing the outer swirler to the inner swirler such that a leading edge of the inner swirler is approximately 0.25 inches upstream from a leading edge of the outer swirler.

5. A method in accordance with claim 1 further comprising the step of securing a second and a third annular dome to the first annular dome.

6. A combustor for a gas turbine engine, said combustor comprising:

a plurality of annular domes comprising at least a first annular dome comprising a premixer cup and an axis of symmetry;

an inner swirler within said first dome and comprising a leading edge and a trailing edge;

an outer swirler radially outward from said inner swirler and within said first dome, said outer swirler comprising a leading edge, said inner swirler leading edge upstream from said outer swirler leading edge; and a centerbody radially inward from said inner swirler along said annular dome axis of symmetry.

7. A combustor in accordance with claim 6 further comprising a second and a third annular dome.

8. A combustor in accordance with claim 6 wherein said centerbody comprises a leading edge and a trailing edge, said centerbody leading edge upstream from said outer swirler leading edge.

9. A combustor in accordance with claim 6 wherein said inner swirler leading edge is approximately 0.25 inches upstream from said outer swirler leading edge.

10. A combustor in accordance with claim 6 wherein said centerbody comprises at least one orifice configured to inject fuel into said first annular dome premixer cup.

11. A combustor in accordance with claim 10 wherein said centerbody further comprises a conical first body portion and a cylindrical second body portion, said centerbody first body portion extending downstream from said centerbody second body portion.

12. A combustor in accordance with claim 11 wherein said at least one orifice is disposed in said centerbody first body portion.

13. A combustor in accordance with claim 10 wherein said at least one orifice disposed approximately 0.25 inches upstream from said first body portion.

14. A gas turbine engine comprising a combustor system configured to reduce emissions from said gas turbine engine, said combustor system comprising a combustor comprising a plurality of annular domes comprising at least a first annular dome comprising a premixer cup, an inner swirler, and an outer swirler, said inner swirler disposed radially inward from said outer swirler and comprising a leading edge and a trailing edge, said outer swirler disposed within said annular dome and comprising a leading edge, said inner swirler leading edge being upstream from said outer swirler leading edge.

15. A gas turbine engine in accordance with claim 14 further comprising a centerbody disposed radially inward from said inner swirler and comprising a leading edge and a trailing edge, said centerbody leading edge upstream from said outer swirler leading edge.

16. A gas turbine engine in accordance with claim 14 wherein said inner swirler leading edge approximately 0.25 inches upstream from said outer swirler leading edge.

17. A gas turbine engine in accordance with claim 15 wherein said centerbody further comprises a first body portion and a second body portion, said first body portion substantially cylindrical, said second body portion extending downstream from said first body portion and substantially conical.

18. A gas turbine engine in accordance with claim 17 wherein said centerbody further comprises at least one orifice configured to inject fuel into said annular dome premixer cup.

19. A gas turbine engine in accordance with claim 18 wherein said at least one orifice disposed within said centerbody first body portion.

20. A gas turbine engine in accordance with claim 18 wherein said at least one orifice disposed approximately 0.25 inches upstream from said centerbody second body portion.

* * * * *